US005784744A

United States Patent [19]

Toran

[11] Patent Number: 5,784,744

[45] Date of Patent: Jul. 28, 1998

[54] PORTABLE SHAMPOO DEVICE

[76] Inventor: Steven Toran, P.O. Box 1804, Hoboken, N.J. 07030

[21] Appl. No.: 781,120

[22] Filed: Jan. 9, 1997

[51] Int. Cl.[6] ..... A46B 13/04

[52] U.S. Cl. ..... 15/29; 15/97.1; 401/136; 401/270

[58] Field of Search ..... 15/24, 29, 97.1; 401/136, 270; 601/114

[56] References Cited

U.S. PATENT DOCUMENTS

| | | | |
|---|---|---|---|
| 3,195,537 | 7/1965 | Blasi | 601/114 |
| 3,293,678 | 12/1966 | South | 15/29 |
| 3,658,432 | 4/1972 | Lanusse | 15/24 |
| 3,864,780 | 2/1975 | Watkins | 15/29 |
| 4,335,481 | 6/1982 | Slayman | 15/29 |
| 5,222,268 | 6/1993 | Snodgrass | 15/29 |
| 5,301,381 | 4/1994 | Klupt | 15/29 |
| 5,423,102 | 6/1995 | Madison | 15/29 |
| 5,647,841 | 7/1997 | Groenewold | 15/29 |

FOREIGN PATENT DOCUMENTS

| | | | |
|---|---|---|---|
| 2384558 | 11/1978 | France | 15/24 |
| 3113645 | 10/1982 | Germany | 15/29 |
| 3308134 | 9/1984 | Germany | 15/29 |

*Primary Examiner*—Randall Chin
*Attorney, Agent, or Firm*—M. K. Silverman

[57] ABSTRACT

A portable shampoo device includes a handle housing having a battery-containing region and a cleaning-fluid containing region preferably including a pump for the selectable ejection of quantities of the cleaning fluid. The portable shampoo device also includes a motor housing including a multi-speed direct current motor having a power shaft output. The motor is in electrical communication with electrodes of the battery-containing region of the handle housing. Various different cleaning and drying brushes may be selectably coupled to a distal end of the power shaft output.

3 Claims, 4 Drawing Sheets

PORTABLE SHAMPOO DEVICE

BACKGROUND OF THE INVENTION

In recent years, many devices have been portablized, however, to the knowledge of the inventor, no suggestions have appeared in the area of portable shampooing as, notably, would be used in cleaning and polishing of an automobile.

To the knowledge of the inventor, there does not exist any art in the area of portable shampoo devices for outdoor use and, particularly, for use with a vehicle such as an automobile.

SUMMARY OF THE INVENTION

The instant invention relates to a portable shampoo device, the device particularly including a handle housing having a battery-containing region and a cleaning-fluid containing region preferably including means for the selectable ejection of quantities of said cleaning fluid therefrom. The portable shampoo device further includes a motor housing including a multi-speed direct current motor having a power shaft output thereof, said motor in electrical communication with electrodes of said battery-containing region of the handle housing. Various different cleaning and drying brushes may be selectably coupled to a distal end of said power shaft output. Also, a variety of different fluid ejection patterns may be selected.

It is an object of the present invention to provide a shampooing device particularly adapted for portable outdoor use.

It is another object to provide a portable shampoo device which is adapted for use upon the exterior of automotive vehicles.

It is a further object of the invention to provide a portable shampoo device having particularly utility in the cleaning of upholstery.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 3:
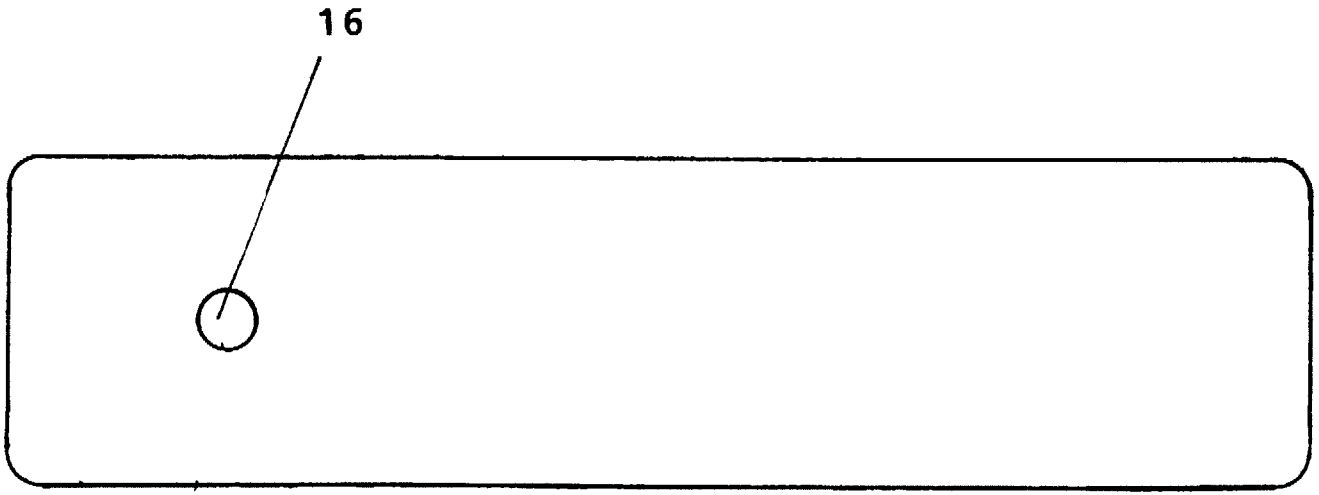
FIG. 3 is a top view of the tank portion thereof.

With reference to the figures, it is to be noted that the instant inventive portable shampoo device includes a handle housing 10 which includes a battery-containing region 12 and a cleaning-fluid containing region 14. As may be noted in the views of FIGS. 3 and 4, the fluid-containing region or tank 14 comprises a tank which may be selectively filled through opening 16 thereof, which opening is, of course, provided with a securable cap (not shown).

Figure 4:
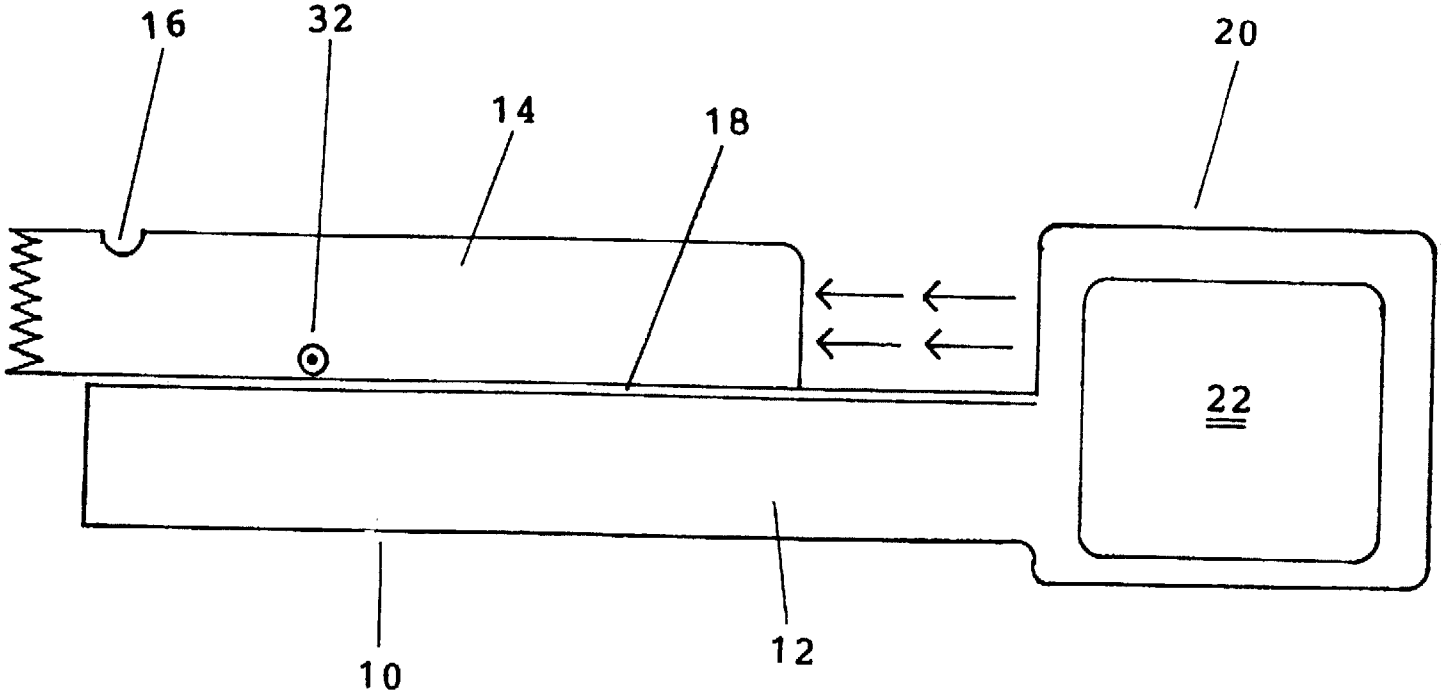
FIG. 4 is an assembly view showing the relationship between the tank portion and battery-containing region of the handle housing.

FIG. 4 illustrates the manner in which the cleaning fluid containing region or tank 14 may be slidably attached to the battery-containing region 12 of the handle by means of a complemental track 18 or of equivalent securable means. Accordingly, it is to be appreciated that the fluid-cleaning region may be readily coupled and decoupled to and from the battery-containing region 12 of the handle housing of the portable shampoo device.

Figure 2:
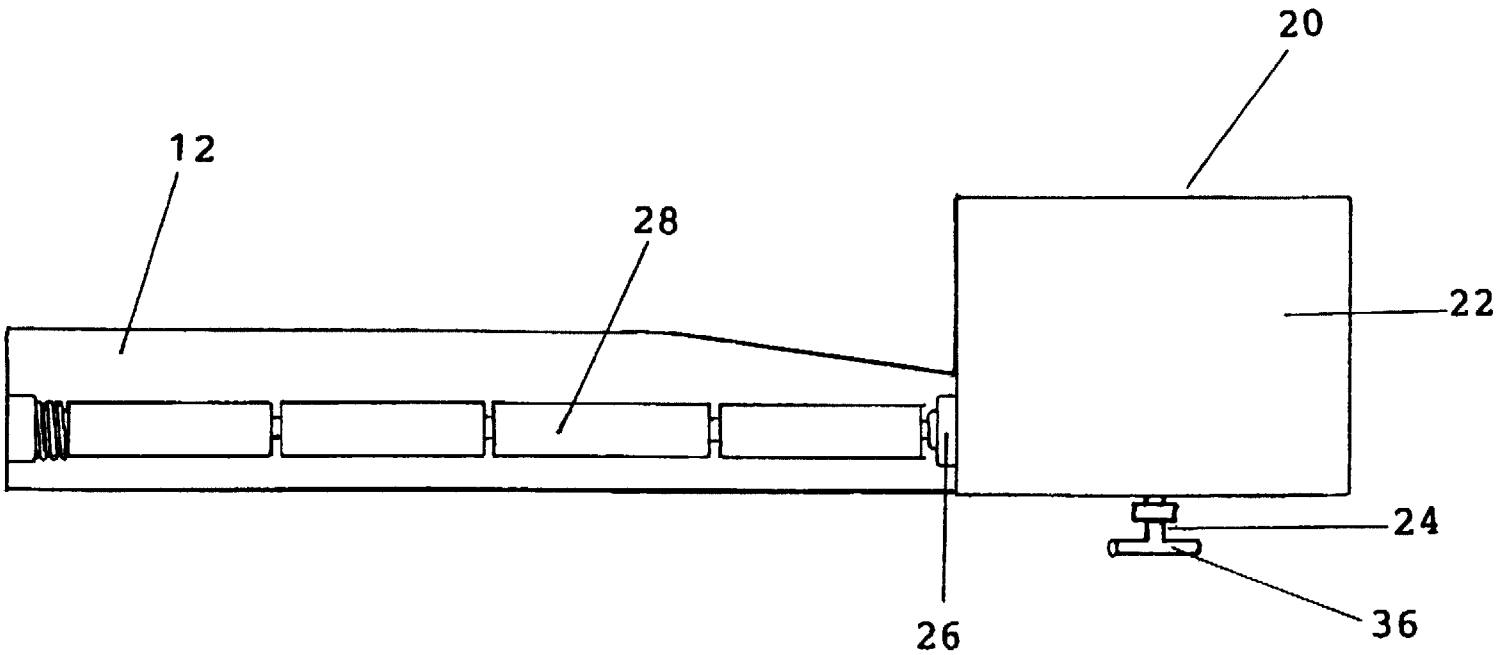
FIG. 2 is a longitudinal cross-sectional schematic view thereof, without the tank portion in place.

With reference to the longitudinal cross-sectional schematic view of FIG. 2, there may be seen motor housing 20 which includes a multi-speed direct current (DC) motor 22 having a rotatable power shaft 24 as a mechanical output thereof.

With further reference to FIG. 2, it may be noted that said motor 22 is, through electrodes 26, in electrical communication with a plurality of rechargeable batteries 28 which are within the battery-containing region 12 of the handle housing 10.

Figure 1:
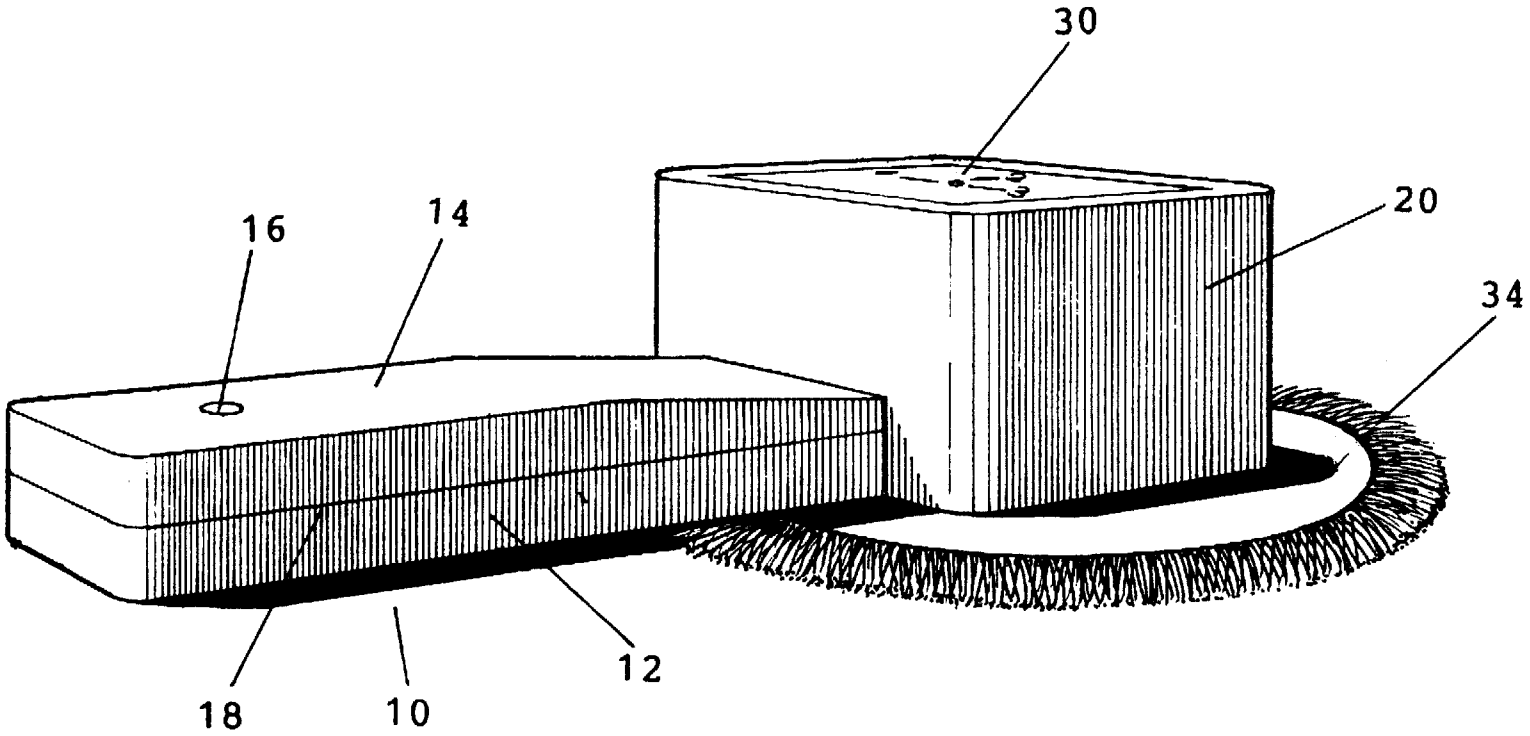
FIG. 1 is a perspective view of the inventive portable shampoo device.

As may be noted in FIG. 1, there is provided a control 30 for motor 22 by which a plurality of different power levels, i.e., speeds for the motor and its power shaft 24 may be selected.

It is further noted that the fluid-containing region 14 is preferably provided with a means for selectable ejection as, for example, by squirting of the cleaning fluid onto the work surface of interest. Such a fluid ejection means would preferably comprise a pump 32, shown schematically in FIG. 4 which would permit selectable withdrawal of fluid from a lower level of the fluid-containing region 14. In a more sophisticated embodiment of the invention, the pump 32 may include means for providing selectably different patterns of fluid ejection.

As may be noted in FIG. 1, a cleaning means such as a circular brush 34 is complementally coupled to a coupling means 36 at a distal end of power shaft 24 (see FIG. 2). As may be appreciated, a variety of difference brushes, shampooing and drying means may be coupled to coupling means 36 to achieve different cleaning objectives. It is, therefore, to be appreciated that, by virtue of the above-described structure, there is provided a portable and cost-effective shampooing device that may be used in connection with cleaning of the interior and exterior of automotive vehicles and which may be used in a number of other environment.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention what I claim as new, useful and non-obvious and, accordingly, secure by Letters Patent of the United States is:

1. A portable shampoo device, comprising:

a handle housing comprising the combination of a first elongated generally flat housing having a cleaning fluid therein, said first housing having a bottom planar surface, and a second elongated generally flat housing having batteries therein, said second housing having an upper planar surface;

means for manually coupling and decoupling said first housing to said second housing, said first and second housings extending generally parallel to each other wherein said bottom planar surface abuts said upper planar surface;

said first housing, when coupled to said second housing, being fluid-tight relative thereto;

a motor housing including a multi-speed direct current motor having a power shaft output thereof, said motor being in electrical communication with electrodes of said batteries, said motor housing being attached to said second housing; and brush means being secured to said power shaft output.

2. The device as recited in claim 1, in which said first housing comprises:

means for selectable ejection of fluid therefrom.

3. The device as recited in claim 2, in which said means for selectable ejection of fluid further comprises:

means for providing selectably different patterns of fluid ejection.

* * * * *